US008613528B2

(12) United States Patent
Marquardt et al.

(10) Patent No.: US 8,613,528 B2
(45) Date of Patent: Dec. 24, 2013

(54) LIGHT FIXTURES COMPRISING AN ENCLOSURE AND A HEAT SINK

(75) Inventors: Craig Eugene Marquardt, Covington, GA (US); Jie Chen, Snellville, GA (US); Seun Ilenbiluan, Conyers, GA (US); Jeffery Allen Watson, Covington, GA (US); Daniel Edward Sicking, Lawrenceville, GA (US); Aaron James Becker, Covington, GA (US); Mark Anthony Hand, Covington, GA (US)

(73) Assignee: ABL IP Holding LLC, Conyers, GA (US)

( * ) Notice: Subject to any disclaimer, the term of this patent is extended or adjusted under 35 U.S.C. 154(b) by 234 days.

(21) Appl. No.: 13/102,767

(22) Filed: May 6, 2011
(Under 37 CFR 1.47)

(65) Prior Publication Data

US 2012/0008331 A1 Jan. 12, 2012

Related U.S. Application Data

(60) Provisional application No. 61/332,436, filed on May 7, 2010.

(51) Int. Cl.
*F21V 29/00* (2006.01)

(52) U.S. Cl.
USPC ..... 362/294; 362/373; 362/249.02; 362/218; 362/217.11

(58) Field of Classification Search
USPC ..... 362/547, 218, 249.02, 294, 373, 217.1, 362/217.11
See application file for complete search history.

(56) References Cited

U.S. PATENT DOCUMENTS

| | | | | |
|---|---|---|---|---|
| 4,937,714 | A * | 6/1990 | Witt | 362/255 |
| 5,857,767 | A * | 1/1999 | Hochstein | 362/294 |
| 7,140,733 | B2 * | 11/2006 | Takezawa et al. | 353/52 |
| 7,144,145 | B2 * | 12/2006 | Watanabe et al. | 362/544 |
| 7,170,751 | B2 * | 1/2007 | Mayer | 361/719 |
| 7,572,027 | B2 * | 8/2009 | Zampini et al. | 362/225 |
| 7,600,897 | B2 * | 10/2009 | Tsai | 362/294 |
| 8,072,124 | B2 * | 12/2011 | Liu et al. | 362/219 |
| 8,317,369 | B2 * | 11/2012 | McCanless | 362/368 |
| 2003/0058650 | A1 * | 3/2003 | Shih | 362/294 |
| 2003/0058656 | A1 * | 3/2003 | Yamaguchi | 362/547 |
| 2005/0265019 | A1 * | 12/2005 | Sommers et al. | 362/217 |
| 2005/0281033 | A1 * | 12/2005 | Coushaine et al. | 362/294 |
| 2006/0098441 | A1 * | 5/2006 | Chou | 362/294 |
| 2008/0037239 | A1 * | 2/2008 | Thomas et al. | 362/92 |
| 2010/0302777 | A1 * | 12/2010 | Knoll et al. | 362/235 |
| 2011/0110096 | A1 * | 5/2011 | Hong et al. | 362/294 |
| 2011/0110107 | A1 * | 5/2011 | Kawato | 362/373 |

* cited by examiner

*Primary Examiner* — Ismael Negron

(74) *Attorney, Agent, or Firm* — Kilpatrick Townsend & Stockton, LLP

(57) ABSTRACT

Light fixtures including at least an enclosure, a heat sink, and a light-emitting diode. In one embodiment the heat sink has a first portion having fins (that protrudes outside of the enclosure) and a second portion to house and mount the LEDs (that is positioned within the enclosure). Certain embodiments also provide for gaskets and other structure to prevent leakage between the heat sink and the enclosure, such that the light fixture is water-resistant.

12 Claims, 12 Drawing Sheets

LIGHT FIXTURES COMPRISING AN ENCLOSURE AND A HEAT SINK

FIELD

The present subject matter relates generally to light fixtures, and more specifically, to the use of light emitting diodes in a light fixture having an enclosure and a heat sink.

BACKGROUND

An important consideration in the design of light fixtures is selection of the light source. Fluorescent or incandescent lamps have long been the light source of choice in many light fixtures used in commercial applications. But fluorescent and incandescent lamps have drawbacks. For example, fluorescent lamps may result in undesirable lighting that is focused and intensely directed beneath the lamp but dark in areas peripheral to the lamp. Both fluorescent and incandescent lamps require a high level of energy, and thus, are more expensive to operate. Incandescent lamps burn out relatively quickly, which causes material waste. Fluorescent lamps contain mercury, a toxic substance. In general, fluorescent and incandescent lamps are not very "green" or environmentally friendly. Such lamps may also require increased operator time in changing out the lamp when it is burned out.

Another light source that is gaining in popularity is the light-emitting diode, or LED. LEDs might be desirable in certain applications because they generally require less power than fluorescent and incandescent lamps, and they also generate less waste. LEDs last longer, which may be desirable to users who operate the light fixture for long hours and could reduce the frequency of lamp replacements. Finally, LEDs do not contain any toxic mercury.

Despite the fact that it may not be desirable to use fluorescent or incandescent lamps, it may still be desirable to use at least part of the light fixture that was designed to house the fluorescent or incandescent lamp, as long as the special operating characteristics of LEDs are appropriately addressed. Manufacturing equipment and procedures that were used to make the existing enclosure can continue to be used to house the LED boards. Finally, re-using an existing enclosure preserves a consistent look in a room that may already be equipped with light fixtures. (Otherwise, the room may have some light fixtures with new enclosures and some with older ones that look different from one another.)

In general, it may be desirable to re-use at least some parts of a light fixture design (and in particular, an enclosure of a light fixture) to house an LED board or other light source. One problem arises, however, in managing the thermal energy that may be produced by LEDs. One way to manage thermal energy is to incorporate heat sinks into the light fixture. An existing fixture may not be provided with such heat sinks, however, and may not have room to incorporate such heat sinks. Managing the thermal energy may be particularly problematic if the enclosure of the light fixture is made of a material that is insulating, such as plastic, that traps the thermal energy inside the enclosure.

Another problem is that modifications to an existing enclosure may make the light fixture unsuitable for use in particular applications. For example, if the light fixture is to be used in an environment that may be exposed to water, such as a parking garage or other outdoor environment, then it may be desirable to provide a water-resistant light fixture. Modifying an existing enclosure may involve creating apertures in the enclosure, which may introduce water into the light fixture, damaging the components inside.

Thus, it is desirable to re-use parts of an existing light fixture, such as an enclosure, to house LED boards or other light sources.

It is also desirable to manage the thermal energy produced by such LEDs inside the enclosure, particularly if the enclosure is made of plastic.

Finally, if it is necessary to modify the design of an existing enclosure to house an LED board, then it may be desirable for such modifications to be water-resistant.

SUMMARY

Certain embodiments of the invention provide for light fixtures comprising at least a heat sink and an enclosure to be used to house LED boards or other light sources. In one non-limiting embodiment, the heat sink includes a first portion having fins oriented outside of the enclosure and a second portion that extends into the enclosure and couples to an LED mount. The heat sink may be made of a thermally conductive material such that thermal energy is conducted away from the LEDs, into the heat sink, and out of the enclosure. Certain embodiments also provide for gaskets and other structure to prevent leakage between the heat sink and the enclosure, such that the light fixture is water-resistant. Thus, embodiments of the light fixture may house LEDs and related electric components inside a water-resistant enclosure and cool those components by transferring thermal energy (via conductive and/or convective cooling) away from the fixture.

DETAILED DESCRIPTION OF THE DRAWINGS

Reference will now be made in detail to various and alternative exemplary embodiments and to the accompanying drawings, with like numerals representing substantially identical structural elements. Each example is provided by way of explanation, and not as a limitation. It will be apparent to those skilled in the art that modifications and variations can be made. For instance, features illustrated or described as part of one embodiment may be used on another embodiment to yield a still further embodiment. Thus, it is intended that this disclosure includes modifications and variations.

Figure 1:
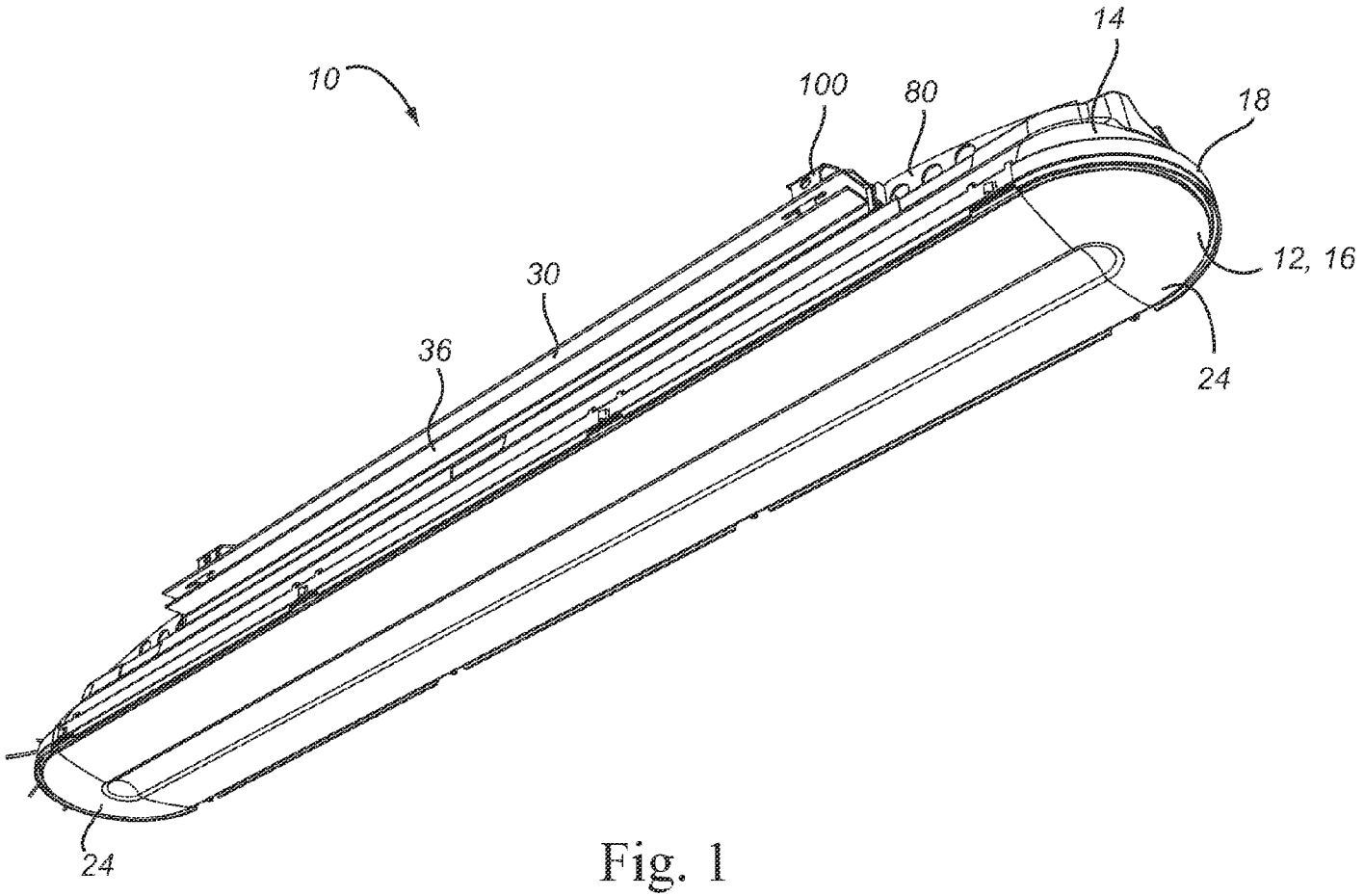
FIG. 1 shows a bottom perspective view of a light fixture according to one embodiment.
Figure 2:
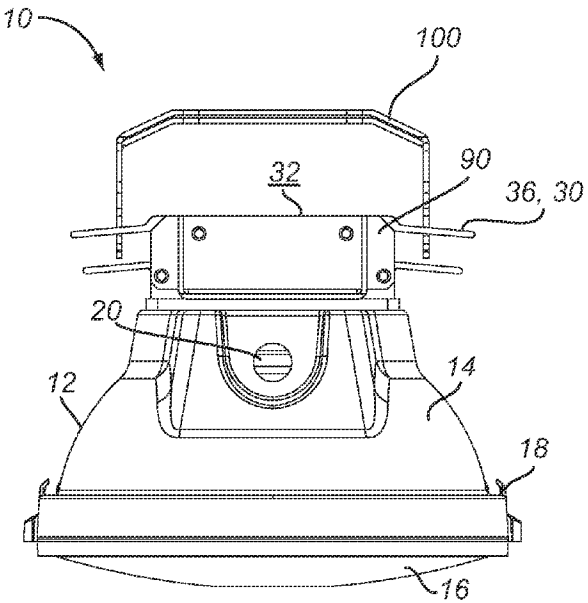
FIG. 2 shows an end view of the light fixture in FIG. 1.
Figure 3:
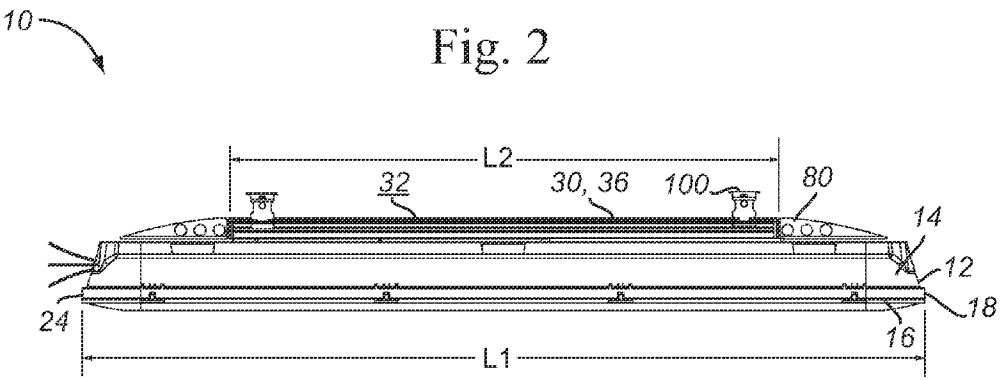
FIG. 3 shows a side elevation view of the light fixture in FIG. 1.
Figure 7A:
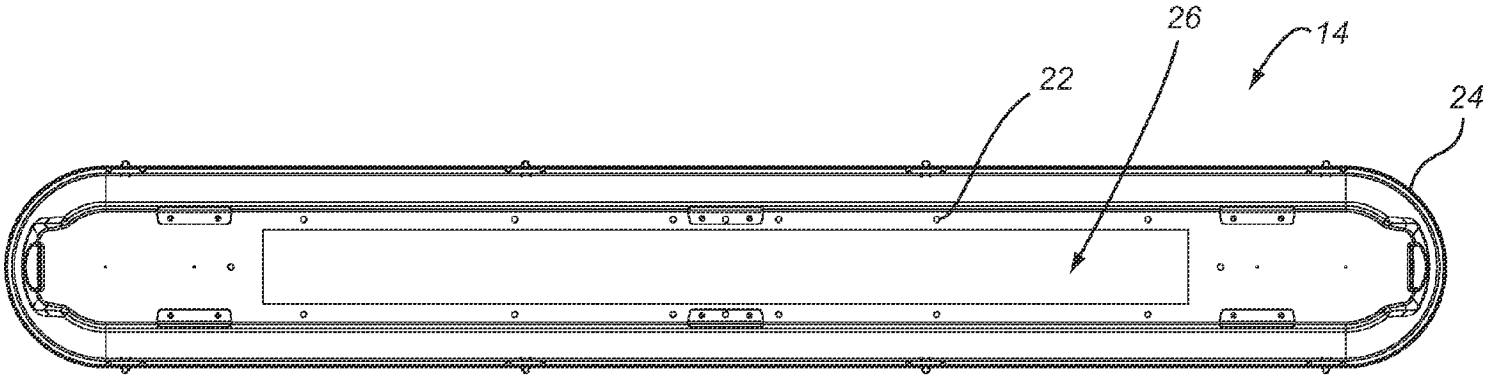
FIG. 7A is a top plan view of an embodiment of the top portion of an enclosure.
Figure 7B:
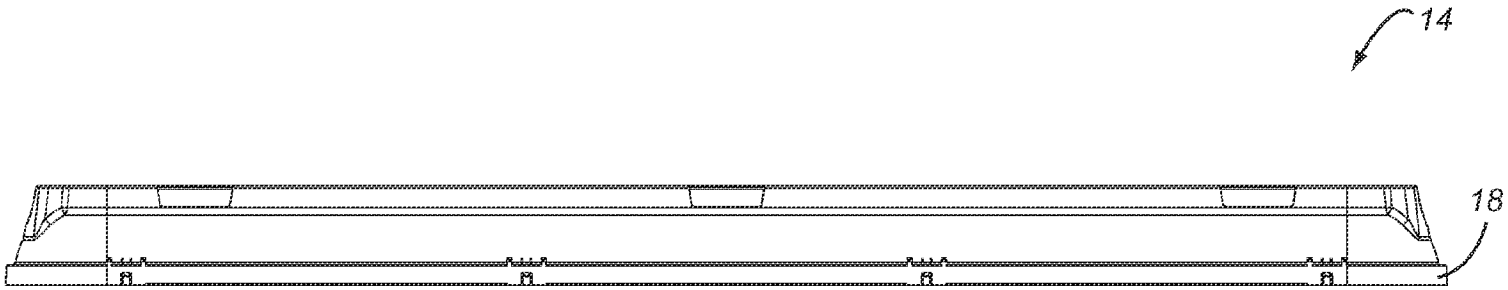
FIG. 7B is a side elevation view of the top portion of FIG. 7A.
Figures 8A, 8B, 8C:
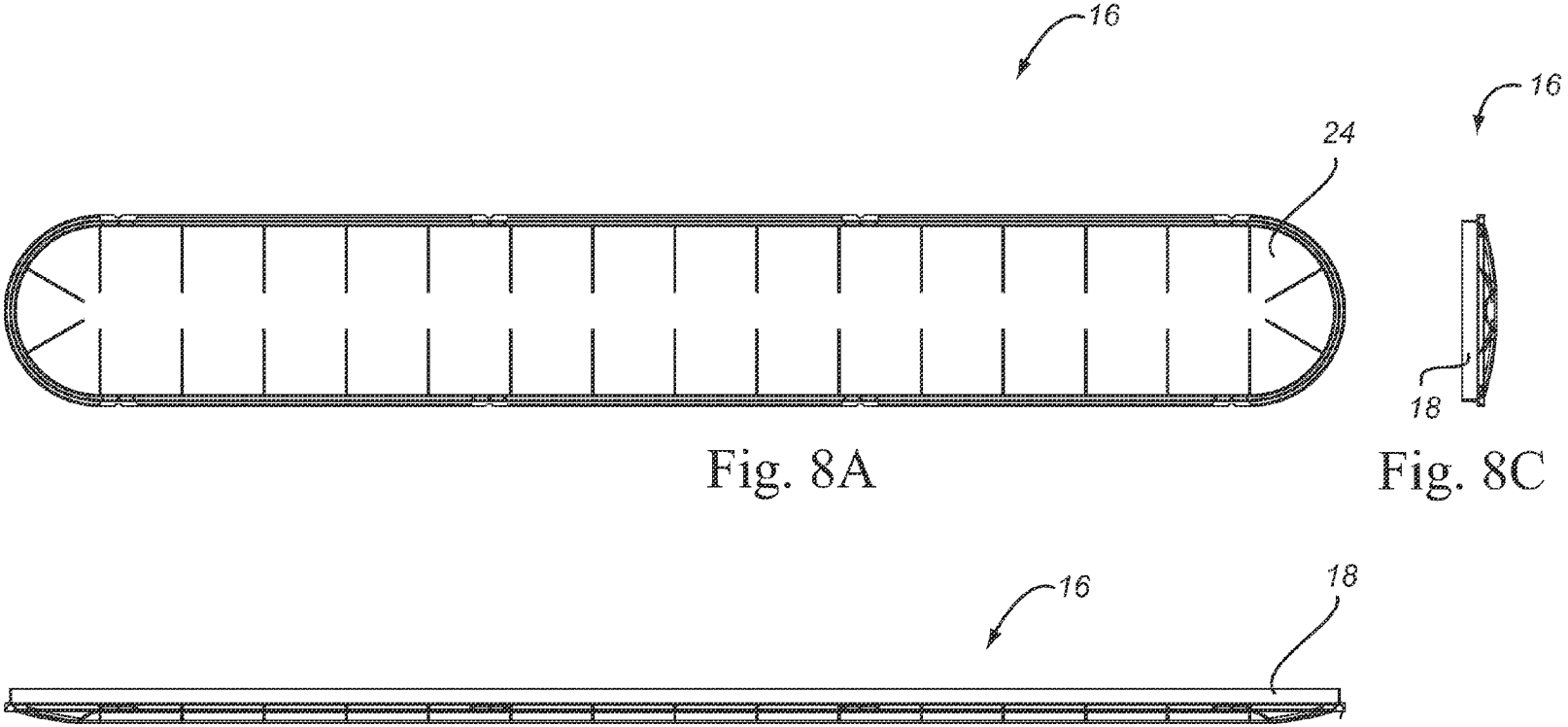
FIG. 8A is a top plan view of the bottom portion of an enclosure.
FIG. 8B is a side elevation view of the bottom portion of FIG. 8A.
FIG. 8C is an end elevation view of the bottom portion of FIG. 8A.

FIGS. 1-5 illustrate an exemplary embodiment of a light fixture 10. FIG. 1 shows a bottom perspective view of the fixture 10 as would be seen from below if the fixture 10 was mounted on a ceiling or other structure. The visible components of fixture 10 may include an enclosure 12 that has a top portion 14 and a bottom portion 16. FIGS. 7 and 8 show more detailed views of the top and bottom portions 14, 16 of enclosure 12 in isolation. As shown in FIG. 2, the top portion 14 of enclosure 12 is generally bell-shaped, defining a cavity 13 to house components (e.g., electrical components 62 and LED board 76) of the fixture 10. Also, as shown in FIG. 7A, the top portion 14 may define a cut-out 26 that provides access to the cavity 13 of the top portion 14, wherein the cut-out 26 may receive a portion of a heat sink 30, as described below. FIG. 8A is a top plan view of the bottom portion 16 of enclosure 12. The surface that is visible in FIG. 8A would face inward to the cavity 13; in other words, FIG. 8A shows the opposite side of the bottom portion 16 as is visible in FIG. 1. FIG. 8A shows optional ribs that may be included on the bottom portion 16 for added strength. As shown in FIGS. 8B and 8C, the bottom portion 16 is slightly rounded. The bottom portion 16 may serve as a lens to distribute light that is emitted from a light source contained in the fixture 10. One or both of the top or bottom portions 14, 16 of enclosure 12 may include a lip 18 with snaps or other structure (such as apertures to receive mechanical fasteners) to couple the top portion 14 to the bottom portion 16. The enclosure 12 may be of any shape. In the illustrated embodiment, the ends 24 of the top and bottom portions 14, 16 are curved (as shown in FIG. 1), and the enclosure 12 has an overall length L1 (as shown in FIG. 3).

In some embodiments, the enclosure 12 may have been originally designed for use with a fluorescent or incandescent lamp. The enclosure 12 may be made of plastic such as a polycarbonate, or another material that is thermally insulating. Thus, certain embodiments described herein relate to the modification of enclosure 12 to be used with LEDs, or another light source that may require a heat sink to conduct thermal energy.

Figure 4A:
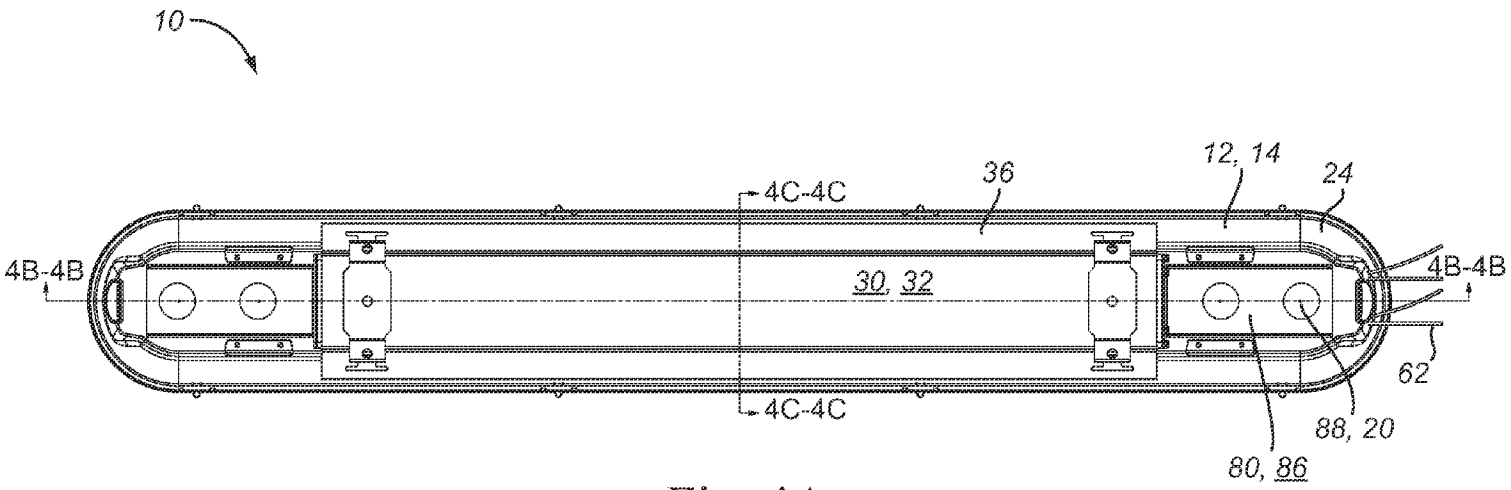
FIG. 4A shows a top plan view of the light fixture in FIG. 1.
Figure 6A:
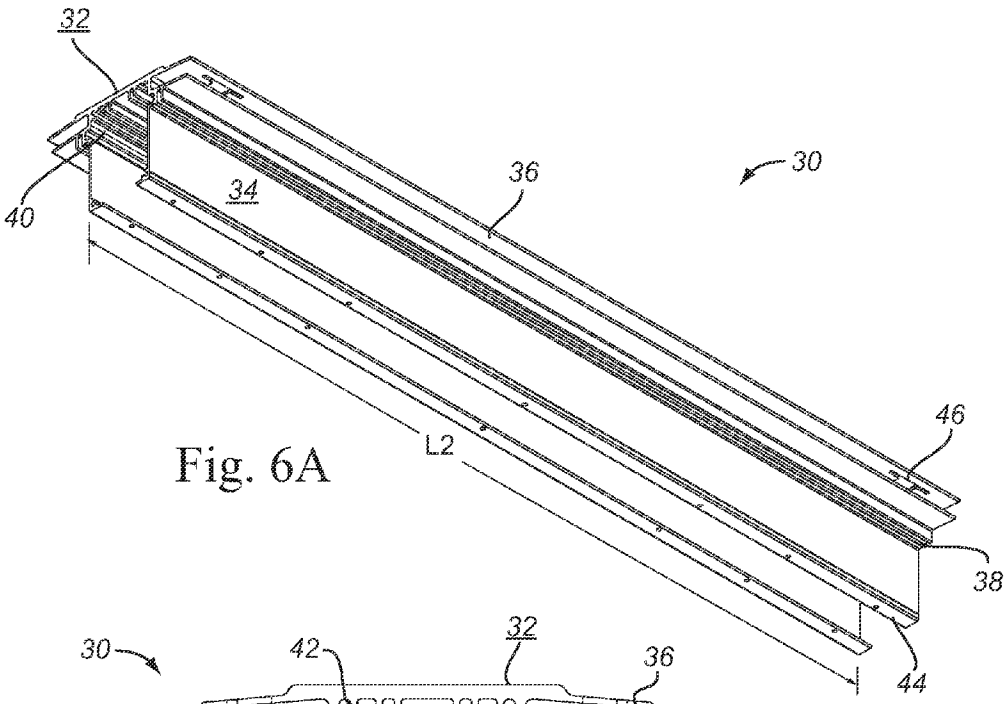
FIG. 6A is a bottom isometric view of an embodiment of a heat sink.

One such modification includes coupling of a heat sink 30 with the enclosure 12. FIGS. 6A and B show detailed views of an embodiment of a heat sink 30. In this non-limiting embodiment, the heat sink 30 includes an upper surface 32, two sets of fins 36 proximate the top of the heat sink 30, and two sidewalls 34 extending downwardly from a fin within each set of fins 36. In some embodiments, the two sidewalls 34 are parallel. As best seen in FIG. 4C, the heat sink 30 is positioned partially within the enclosure 12 and thermally coupled to the LEDs 76 (as described below) to provide a path for conducting heat from the LEDs 76.

The heat sink 30 has an overall length L2. In the embodiment shown in FIG. 6A, each of the sidewalls 34 and the fins 36 extend the full length of L2, but in other embodiments, the sidewalls 34 and/or the fins 36 may be discontinuous or may not extend the full length L2. In the particular embodiment shown in FIG. 3, the length L1 of the enclosure 12 is greater than the length L2 of the heat sink 30. The particular lengths are non-limiting; in other embodiments, the two lengths L1, L2 may be more or less equal to one another.

Figure 4C:
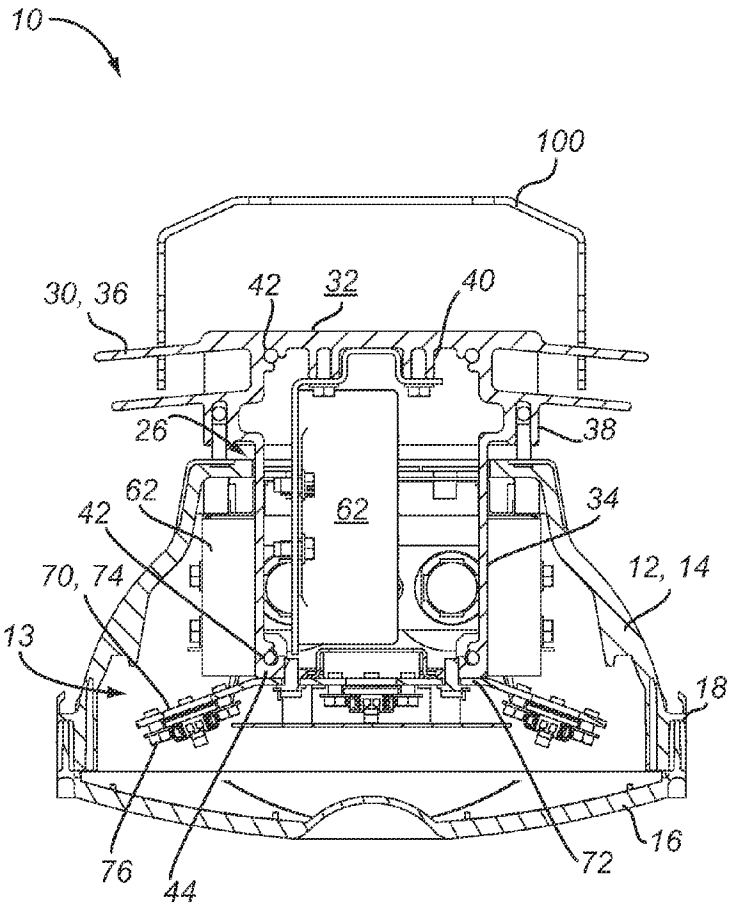
FIG. 4C is a cross-sectional view taken along line 4C-4C of FIG. 4A.
Figure 5:
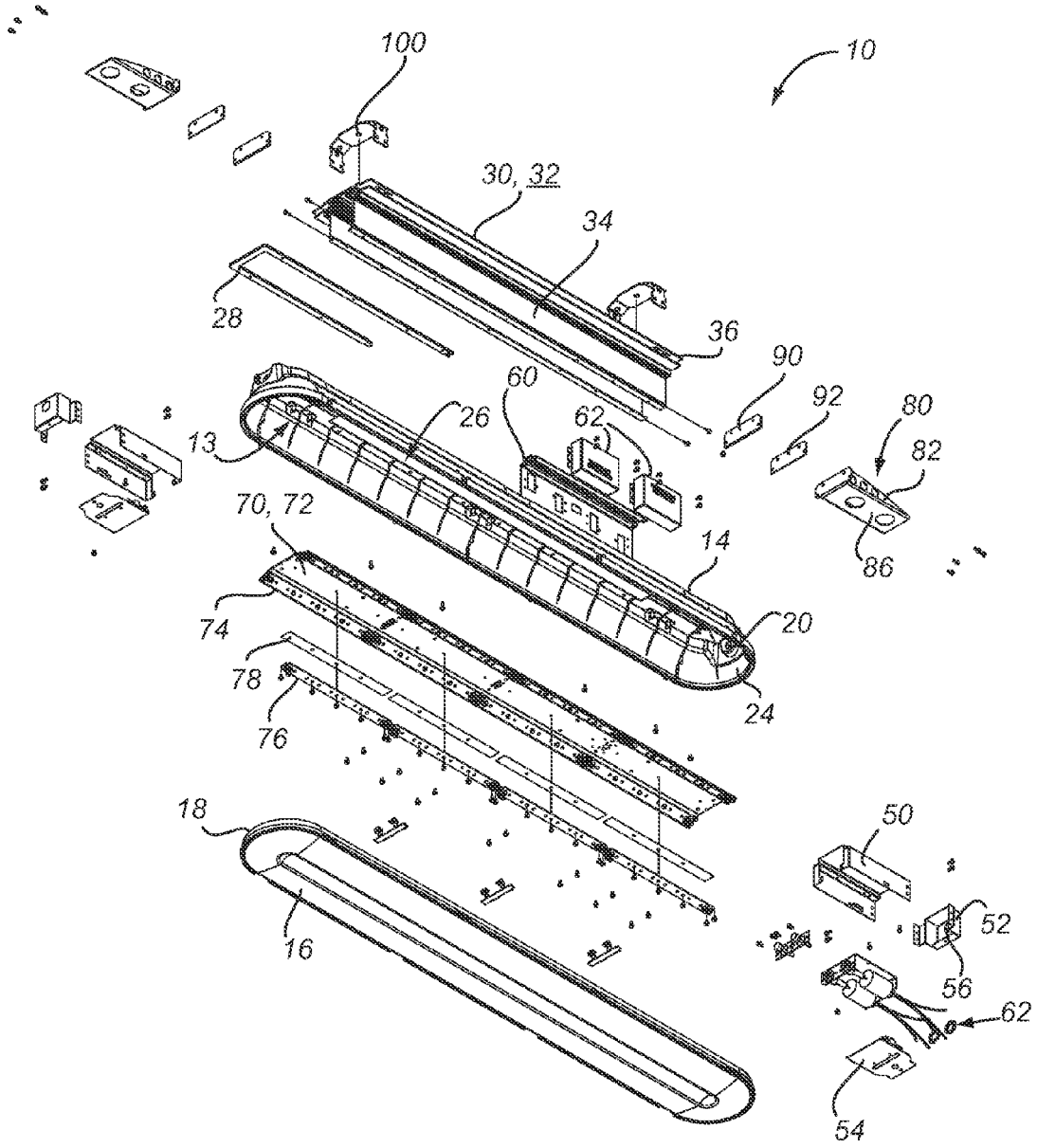
FIG. 5 is an exploded view of the light fixture in FIG. 1.
Figure 6B:
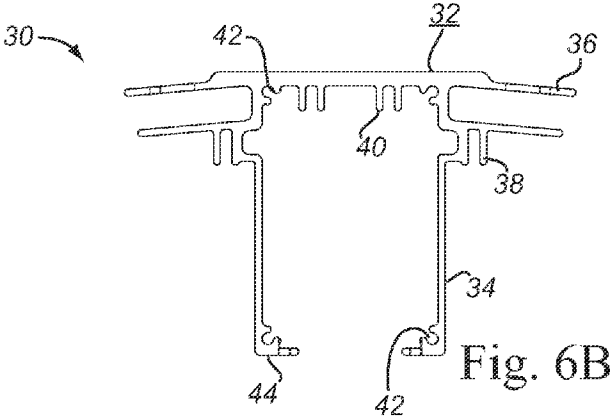
FIG. 6B is an end elevation view of the heat sink of FIG. 6A.
Figure 10A:
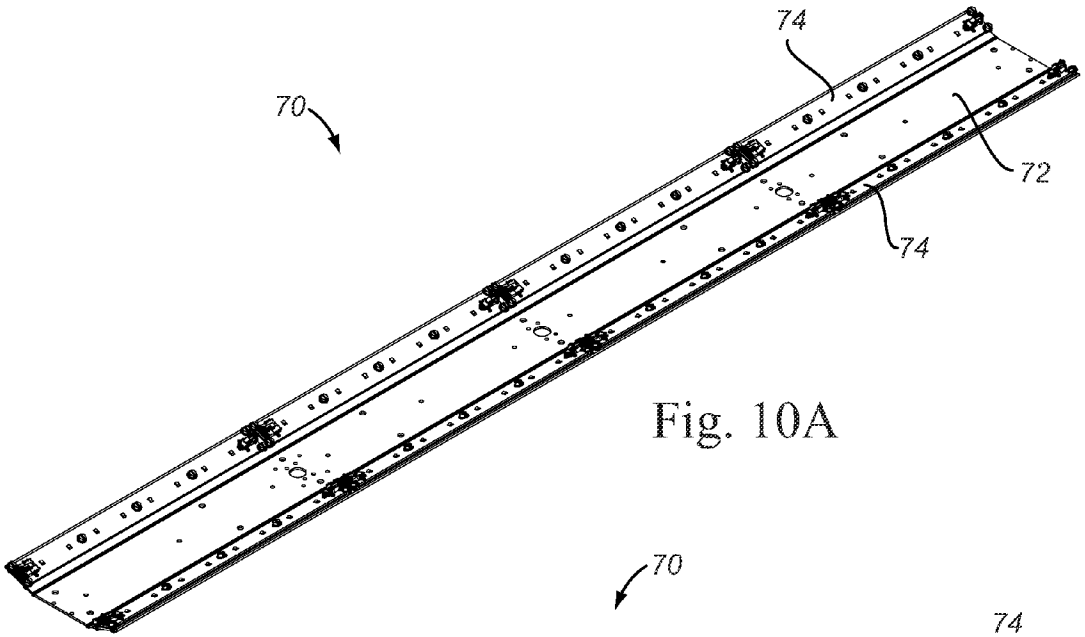
FIG. 10A is an isometric view of an embodiment of a mounting panel for an LED board.
Figure 10B:
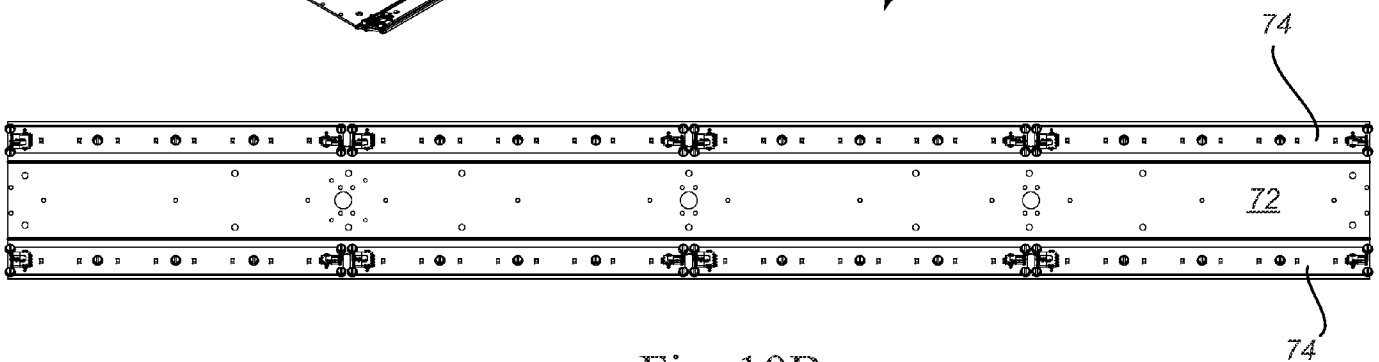
FIG. 10B is a top plan view of the mounting panel of FIG. 10A.

As shown in FIGS. 4C and 6, an end of each sidewall 34 may include a ledge 44 for coupling a mounting panel 70 and LED board 76 to the sidewall 34 of the heat sink 30. A detailed view of the mounting panel 70 is shown in FIGS. 10A and 10B. In certain embodiments, the mounting panel 70 may include a top section 72 and two side sections 74, each of which are coupled to an LED board 76. As shown in FIGS. 10A and 10B, the mounting panel 70 may also include apertures and other structure for mounting the LED board 76 and other structure. In the embodiment shown in the figures, the side sections 74 are angled such that the LEDs 76 emit light in areas peripheral to the area immediately below the fixture 10. It is not necessary for the side sections 74 to be angled, however. If desired, a thermal interface material 78 (best shown in the exploded view of FIG. 5) may be placed between the mounting panel 70 and the LED board 76. Examples of a thermal interface material 78 include graphite materials, or graphite with polymer additives. Two non-limiting examples are the HITHERM and SPREADERSHIELD products manufactured by the company GrafTech International Holdings Inc., based in Lakewood, Ohio.

Figure 12A:
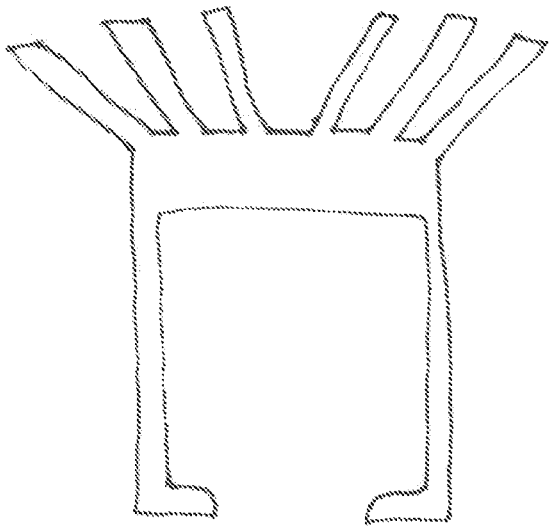
FIG. 12A is an end view of one alternative embodiment of a heat sink.
Figure 12B:
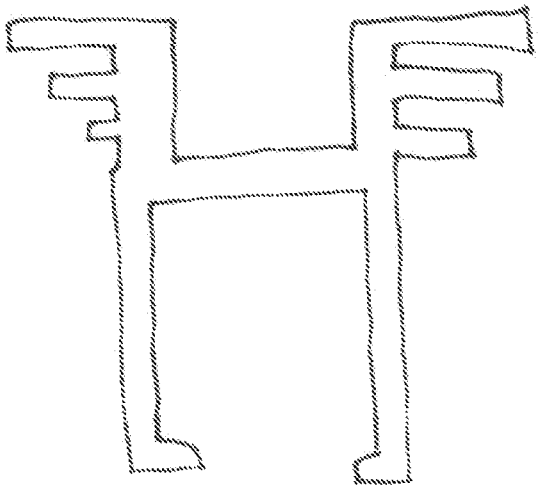
FIG. 12B is an end view of another alternative embodiment of a heat sink.

The heat sink 30 be made of a thermally conductive material, such as metal, including aluminum, steel, copper, or metal alloys to conduct heat away from the LED board 76. Additionally, and as shown in FIG. 4C, fins 36 on the heat sink 30 are located exterior the enclosure 12. Air flows within the channels formed between the fins 36 to convectively cool the fixture 10. The particular number and configuration of fins 36 is non-limiting. In the exemplary embodiment shown in FIG. 6, each set of fins 36 comprises two individual fins that are generally parallel to one another. Additionally, the fins 36 are angled slightly downward with respect to the upper surface 32, which may be desirable if the fixture 10 is to be used in a wet environment, such that water does not accumulate on the upper surface 32 and can run off of the fins 36. In other embodiments, such as in FIGS. 12A and 12B, there may be more individual fins in each set of fins, or the fins may be non-parallel and/or angled upward. As shown in FIGS. 2 and 3, at least one fin 36 may define a cut-out 46 to receive a mounting bracket 100 for mounting the fixture to a ceiling or other structure.

Figure 9A:
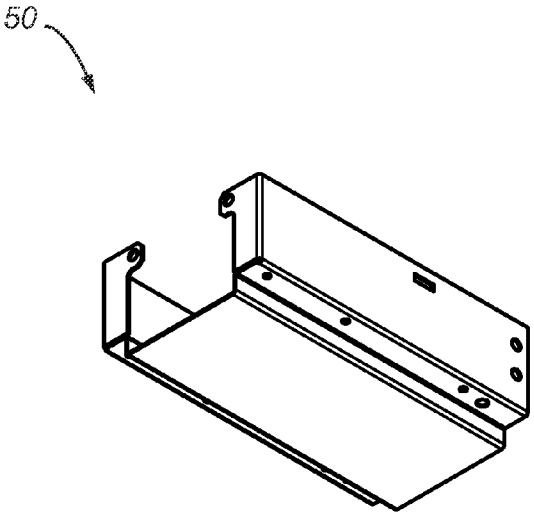
FIG. 9A is an isometric view of an embodiment of a channel
Figure 9B:
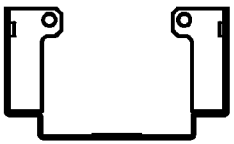
FIG. 9B is an end elevation view of the channel of FIG. 9A.

Electric components 62 used in powering and operating the fixture 10 may be housed in the space defined between the two sidewalls 34. For example, the cross-sectional views of FIGS. 4B and C show an electric component 62 mounted between the sidewalls 34. Additionally, other structure may be provided to mount to the outer surfaces or ends of the sidewalls 34 to house other electric components 62. For example, FIG. 5 shows a side bracket 60 that may be mounted to the outer surfaces of the sidewalls 34. Additional electric components 62 may then be secured between the side bracket 60 and the sidewall 34. Additionally, a channel 50 (with top plate 54 and end cap 52) may be provided to mount to the ends of the sidewalls 34. A detailed view of the channel 50 is shown in FIGS. 9A and 9B. The channel 50 may be used to house other electric components 62. If desired, the end cap 52 of channel 50 may be provided with a drill spot 56 (which aligns with a drill spot 20 provided in top portion 14 of enclosure 12) that may be used to access the components 62 if necessary. As used herein, "drill spot" refers to an area of material that is defined by a recessed or indented boundary, such as a circle, that makes the boundary relatively weak such that it can be drilled or cut out to create a hole within the boundary. As shown in FIGS. 4C and 6A, inner embossed tabs 40 and channels 42 may be provided within the heat sink 30 to provide a mount for the electric components 62 described herein. Thus, electric components 62 may be housed in the space between the sidewalls 34, or mounted to the outer surfaces or ends of the sidewalls 34 (with channel 50 or side bracket 60). The components 62 may include, but are not limited to, surge protectors, fuse holders, LED drivers, or control modules. It may be desired to position the electric components 62 closer to the ends of the heat sink 30 such that the components 62 may be accessed through drill spots 20 defined in the enclosure 12 (shown in FIG. 2).

As shown in FIG. 4C, when assembled, the sidewalls 34 of heat sink 30 extend into the cut-out 26 defined in the top portion 14 of enclosure 12. Inserting the heat sink 30 in an enclosure 12 may require provision of a cut-out 26 in the top portion 14 of the enclosure 12 to receive the heat sink 30. Outer tabs 38 defined on the heat sink 30 may be used to securely couple the heat sink 30 to the top portion 14 of the enclosure 12. When assembled, heat generated by the LEDs 76 is conducted away from the LEDs 76 via the heat sink 30, and air flowing along the fins 36 convectively cool the fixture 10. If the fixture 10 is to be used in an environment that might be exposed to water (such as rain water in a parking garage), then it may be desirable to provide a gasket 28 (shown in FIG. 5) between the cut-out 26 of the enclosure 12 and the heat sink 30. The gasket 28 may help to prevent leakage into the enclosure 12.

Figure 4B:
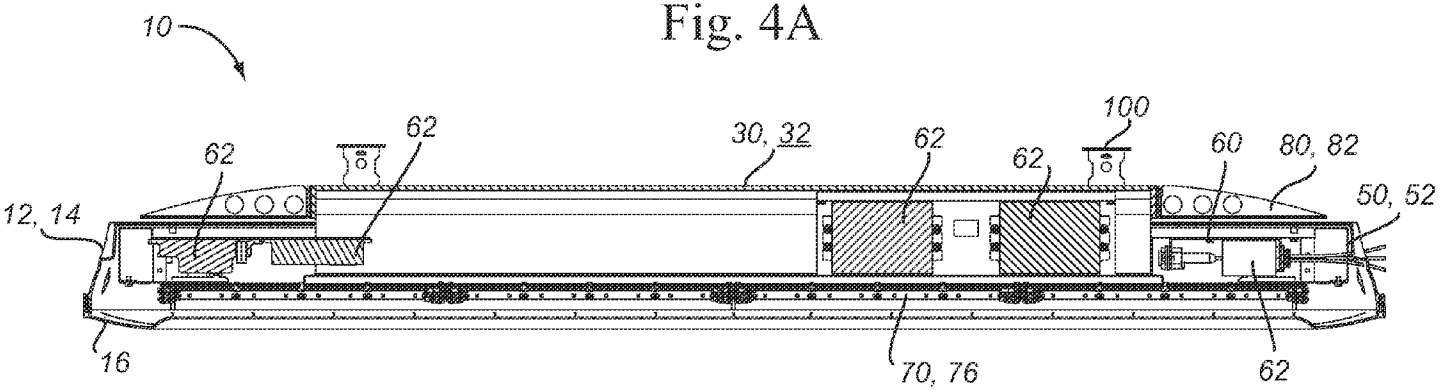
FIG. 4B is a cross-sectional view taken along line 4B-4B of FIG. 4A.
Figure 11:
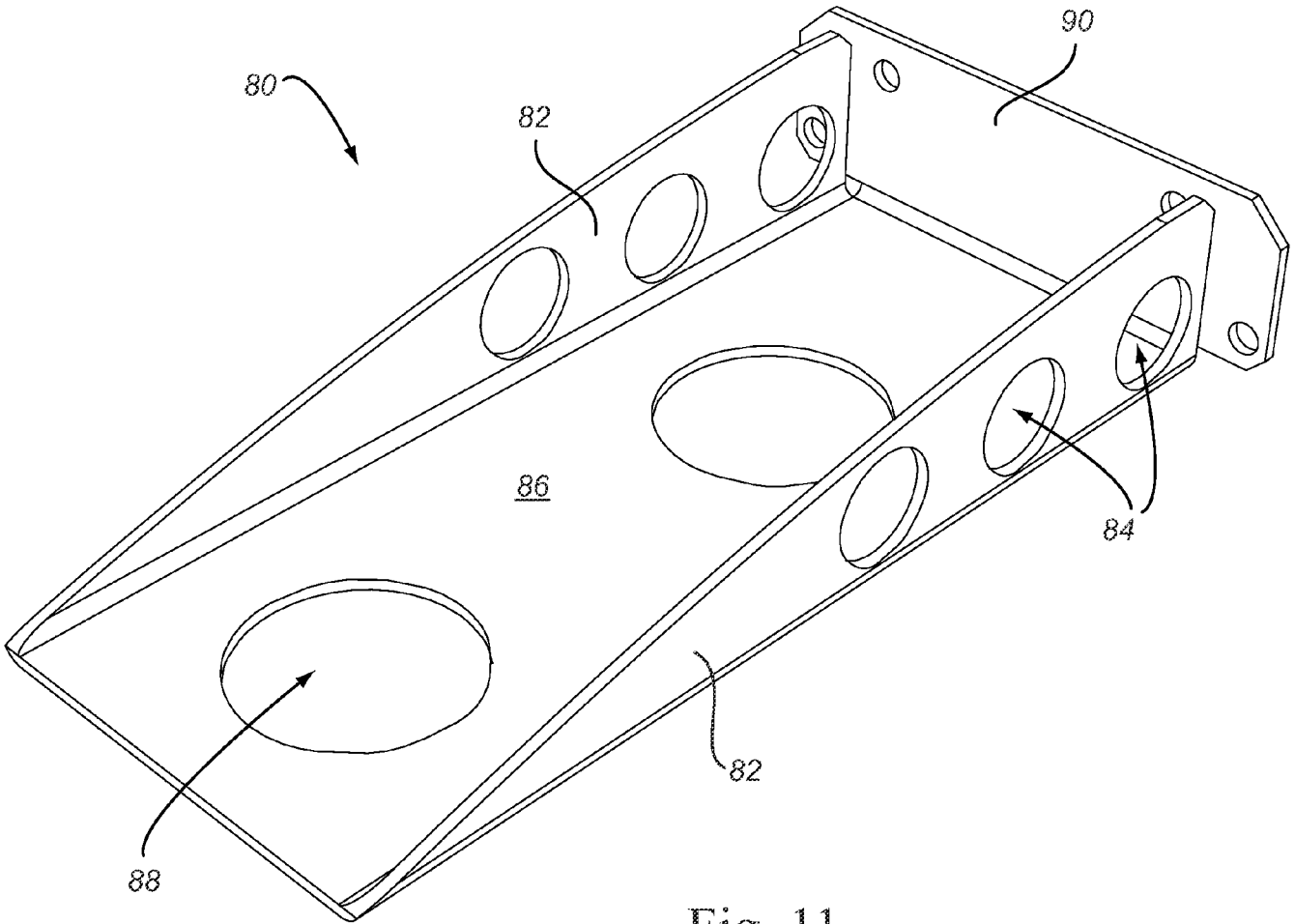
FIG. 11 is an isometric view of an embodiment of a transition piece.

As shown in FIGS. 3 and 4B, a transition piece 80 may be coupled to one or both of the heat sink 30 or the top portion 14 of enclosure 12 to impart a polished appearance to the fixture. A detailed view of transition piece 80 is shown in FIG. 11. The transition piece 80 may include structure to prevent water leakage into fixture 10, and may also be aesthetically pleasing to a viewer. The transition piece 80 may include sidewalls 82, bottom surface 86, and end cap 90. End cap 90 may be mounted to the end of heat sink 30 to cover any openings at the end of heat sink 30. If desired, a gasket 92 may be mounted between the heat sink 30 and end cap 90 to prevent water leakage. As shown in FIG. 4A, the bottom surface 86 of transition piece 80 may include drill spots 88 that align with other drill spots 20 of enclosure 12, and may be used to access the inside of enclosure 12 if needed. The sidewalls 82 of transition piece 80 may be curved to provide a visually aesthetic transition between the heat sink 30 and the enclosure 12. Additionally, if desired sidewalls 82 may include decorative apertures 84 or other features for even more aesthetic effect.

Finally, mounting brackets 100 may be provided to couple to cut-outs 46 defined in the heat sink 30. The mounting brackets 100 may be used to mount the fixture 10 to a ceiling or other structure. Any number of mounting brackets 100 may be provided.

The respective components of the light fixture 10 may be made of a variety of materials. For example, in certain embodiments the enclosure 12 is made of plastic such as a polycarbonate. In other embodiments the enclosure 12 may be made of other materials, such as metal. If desired, the enclosure 12 (both top and bottom portions 14, 16) may be made using a mold. Additionally, in certain embodiments the heat sink 30, channel 50, side bracket 60, mounting panel 70, transition piece 80, and mounting brackets 100 (and any end pieces or plates associated with these components) be made of a thermally conductive material, such as metal, including aluminum, steel, copper, or metal alloys. Some or all of these components may be made with an extrusion manufacturing process. Alternatively, some or all of these components may be made by stamping and folding (for example, stamping the shape of transition piece 80 and then folding it). One of skill in the art would realize that substitutions may be made to either the choice of materials or the manufacturing technique for any of the components of fixture 10. For example, the heat sink 30 may be made of some other non-metallic conductive material, and may be made with a mold in some embodiments.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

The invention claimed is:

1. A light fixture comprising:

an enclosure comprising a top portion that defines a cavity and a cut-out for providing access to the cavity;

a heat sink comprising an upper surface, at least one set of fins extending from the upper surface, and two sidewalls extending downwardly from the at least one set of fins, wherein the heat sink is coupled to the enclosure such that the set of fins are positioned exterior to the enclosure and at least a portion of the sidewalls are positioned within the cavity of the enclosure;

a light source assembly coupled to at least one sidewall, wherein the light source assembly comprises a mounting panel and at least one light emitting diode, wherein the heat sink conducts heat generated by the at least one light emitting diode away from the at least one light emitting diode and out of the enclosure; and at least one electric component housed between the sidewalls of the heat sink.

2. A light fixture as in claim 1, wherein the set of fins comprises at least two individual fins that are parallel to one another, and wherein the set of fins is angled downward from the upper surface of the enclosure.

3. A light fixture as in claim 1, wherein the enclosure comprises a polycarbonate and the heat sink comprises metal.

4. A light fixture as in claim 1, wherein the light source assembly further comprises a thermal interface material coupled between the mounting panel and the at least one light emitting diode.

5. A light fixture as in claim 1, wherein the light fixture is water-resistant.

6. A light fixture as in claim 1, wherein the enclosure further comprises bottom portion coupled to the top portion.

7. A light fixture as in claim 6, wherein the bottom portion of the enclosure comprises a lens for refracting light emitted by the at least one light emitting diode.

8. A method of manufacturing a light fixture, the method comprising:

providing an enclosure comprising a top portion and a bottom portion coupled to the top portion to define a cavity;

defining an aperture in the top portion of the enclosure;

providing a heat sink comprising at least one set of fins proximate a top of the heat sink and two opposing sidewalls extending downwardly from the at least one set of fins;

positioning the heat sink within the enclosure such that the at least one set of fins are positioned exterior to the enclosure and at least a portion of the sidewalls are positioned within the cavity of the enclosure;

coupling the heat sink to the enclosure; and coupling a light source assembly to at least one sidewall, wherein the light source assembly comprises a mounting panel and at least one light emitting diode.

9. A method of manufacturing a light fixture as in claim 8, further comprising coupling a gasket between the heat sink and the enclosure.

10. A method of manufacturing a light fixture as in claim 8, further comprising housing at least one electric component between the sidewalls of the heat sink.

11. A method of manufacturing a light fixture as in claim 8, further comprising coupling a side bracket to a sidewall of the pair of sidewalls; and coupling an additional electric component between the sidewall and the side bracket.

12. A method of manufacturing a light fixture as in claim 8, further comprising coupling a transition piece to an end of the heat sink and to the top portion of the enclosure.

* * * * *